United States Patent [19]

Schmelzer et al.

[11] 4,374,726

[45] Feb. 22, 1983

[54] SEPARATION OF HYDROGEN FROM A CATALYTIC REFORMING ZONE EFFLUENT STREAM

[75] Inventors: Eugene Schmelzer, Skokie; Constante P. Tagamolila, Des Plaines, both of Ill.

[73] Assignee: UOP Inc., Des Plaines, Ill.

[21] Appl. No.: 359,325

[22] Filed: Mar. 18, 1982

Related U.S. Application Data

[63] Continuation of Ser. No. 228,515, Jan. 26, 1981, abandoned.

[51] Int. Cl.[3] ..... C10G 47/00; C10G 49/22

[52] U.S. Cl. ..... 208/101; 208/134; 208/138; 585/655

[58] Field of Search ..... 208/101, 134, 138; 585/655

[56] References Cited

U.S. PATENT DOCUMENTS

| | | | |
|---|---|---|---|
| 3,431,195 | 3/1969 | Storch et al. | 208/101 |
| 3,470,084 | 9/1969 | Scott | 208/101 |
| 3,516,924 | 6/1970 | Forbes | 208/65 |
| 3,520,799 | 7/1970 | Forbes | 208/101 |
| 3,520,800 | 7/1970 | Forbes | 208/101 |
| 3,882,014 | 5/1975 | Monday et al. | 208/101 |
| 4,159,937 | 7/1979 | Scott | 208/101 |

*Primary Examiner*—Curtis R. Davis

*Attorney, Agent, or Firm*—James R. Hoatson, Jr.; Robert W. Welch; William H. Page, II

[57] ABSTRACT

A process for the catalytic reforming of a hydrocarbonaceous feedstock at reforming conditions including a pressure of from about 50 to about 250 psig. is disclosed. A portion of the hydrogen-rich vapor phase recovered from the reforming zone effluent at a relatively low pressure is compressed and recycled to the reforming zone without further purification. The balance of said hydrogen-rich vapor phase, or the net hydrogen, is compressed to a relatively high pressure and recontacted with at least a portion of the liquid hydrocarbon phase recovered from said low pressure separation to effect a further purification of said net hydrogen and to maximize the recovery of $C_3$-$C_6$+ material in the liquid phase.

7 Claims, 1 Drawing Figure

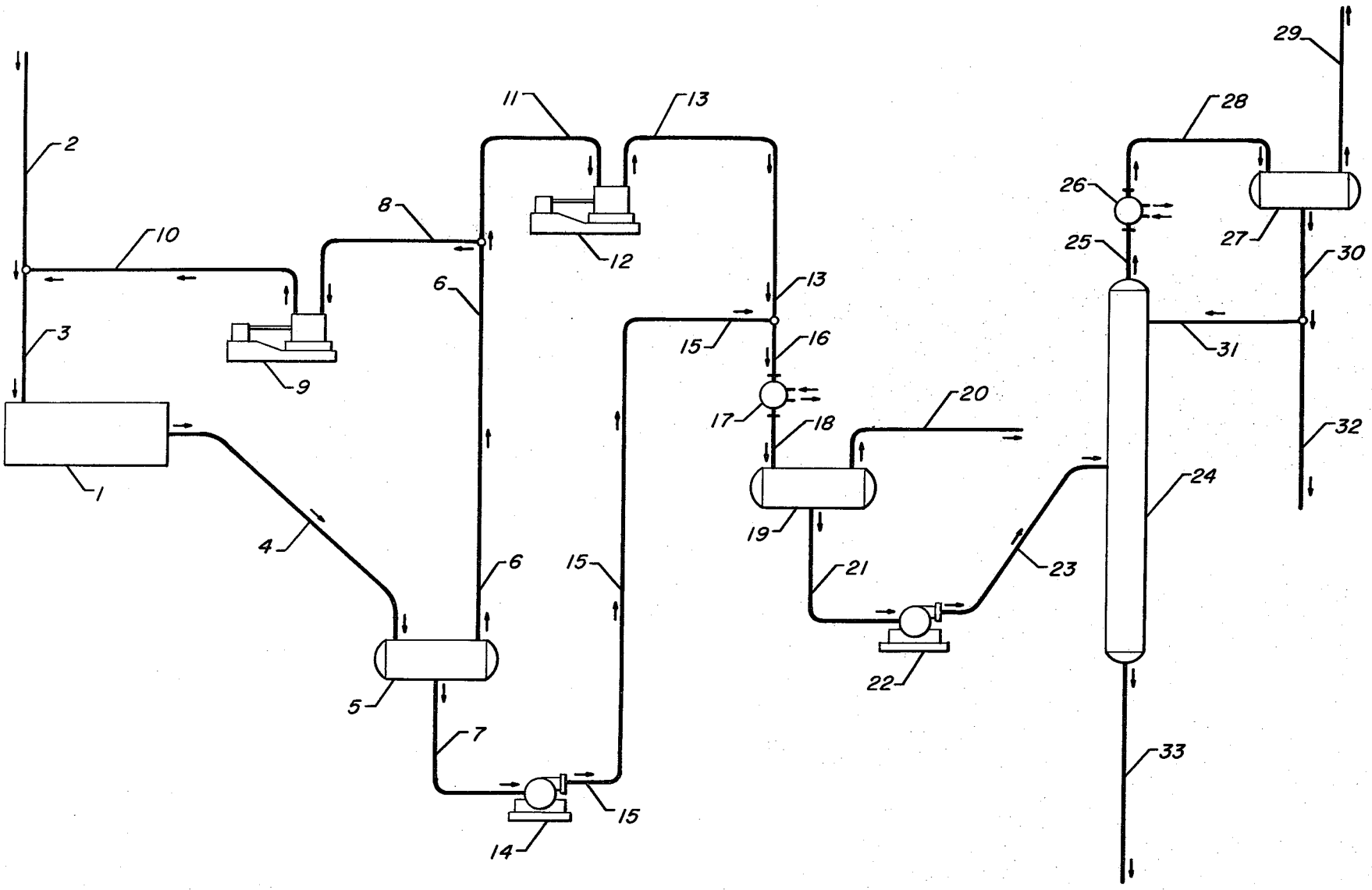
1
2
3
4
5
6
7
8
9
10
11
12
13
14
15
16
17
18
19
20
21
22
23
24
25
26
27
28
29
30
31
32
33

SEPARATION OF HYDROGEN FROM A CATALYTIC REFORMING ZONE EFFLUENT STREAM

CROSS-REFERENCE TO RELATED APPLICATION

This application is a continuation of a copending application Ser. No. 228,515 filed Jan. 26, 1981, and now abandoned.

This invention relates to a hydrocarbon conversion process effected in the presence of hydrogen, especially a hydrocarbon conversion process involving dehydrogenation. More particularly, this invention relates to a catalytic reforming process to convert a hydrocarbon feedstock into gasoline boiling range products, and is specifically directed to the recovery of hydrogen from admixture with the reforming zone effluent stream.

It is well known that high quality petroleum products in the gasoline boiling range including, for example, aromatic hydrocarbons such as benzene, toluene and the xylenes, are produced by the catalytic reforming process wherein a naphtha fraction is passed in contact with a platinum-containing catalyst in the presence of hydrogen. One of the predominant reactions of the reforming process involves the dehydrogenation of naphthenic hydrocarbons. While a considerable portion of the hydrogen recovered in the effluent from the reforming zone is required for recycle purposes, a substantial net excess of hydrogen is available for other uses, for example, the hydrotreating of sulfur-containing petroleum feedstocks.

However, catalytic reforming also involves a hydrocracking function among the products of which are relatively low molecular weight hydrocarbons including the normally gaseous hydrocarbons such as methane, ethane, propane and the butanes, substantial amounts of which are recovered admixed with the hydrogen separated from the reforming zone effluent. These normally gaseous hydrocarbons have the effect of lowering the hydrogen purity to the extent that purification is required before the hydrogen is suitable for recycle and/or use in other hydrocarbon conversion or treating processes. Aside from a desire to recover high purity hydrogen and gasoline product, it is frequently desirable to maximize the recovery of $C_3$–$C_4$ hydrocarbons to satisfy a demand by other hydrocarbon conversion or organic synthesis processes.

Related prior art schemes involving the separation and recovery of hydrogen generally operate the catalytic reforming zone at a pressure of from about 50 to about 250 psig, and the effluent from the reforming zone is separated at a relatively low pressure into a hydrogen-rich vapor phase and a liquid hydrocarbon phase. The low pressure separation is effected in a gas-liquid separator following the reforming zone, and said separator is operated at substantially the same pressure as the reforming zone, allowing for pressure drop through the system. This pressure drop will typically involve from about 50 to about 150 psig. The hydrogen purity of the hydrogen-rich vapor phase recovered from the low pressure separation is generally unsuitable for recycle purposes, and further processing is required.

The total hydrogen-rich vapor phase recovered from the low pressure gas-liquid separator is therefore subjected to a purification process wherein said vapor phase is compressed to about reforming pressure and recontacted with at least a portion of the liquid hydrocarbon phase recovered from said separator. In this manner, light hydrocarbons are absorbed from the vapor phase into the liquid hydrocarbon phase, and a relatively pure hydrogen stream is recovered at about reforming pressure and entirely suitable for recycle purposes. In a variation of the last described process as shown in U.S. Pat. No. 3,516,924, the hydrogen-rich vapor phase recovered from the low pressure gas-liquid separator is compressed to about reforming pressure in two stages, the vapor phase from the second stage of compression being recontacted with at least a portion of the liquid hydrocarbon phase from said separator. This variation further provides for the recycle of a portion of the hydrogen-rich vapor phase from the first stage of compression to the last reactor of a plurality of reactors comprising a reforming zone, the last reactor being at a lower pressure due to pressure drop through the system. A portion of the relatively pure hydrogen from the second stage of compression is then recycled to the first reactor to provide the balance of the required hydrogen.

In any case, while the bulk of relatively pure hydrogen is utilized for recycle purposes, the balance, or the net hydrogen, is available for use, for example, in the hydrotreating of sulfur-containing feedstocks. The net hydrogen is almost invariably increased in pressure and further purified for use in the hydrotreating process. U.S. Pat. Nos. 3,431,195, 3,516,924 and 3,520,799 are representative of the described reforming operation.

It has been observed that hydrogen production in the reforming zone increases with decreasing pressure. It has been further observed that, at the relatively low reforming pressures and improved catalyst formulations herein contemplated, the hydrogen purity of the vapor phase recovered from the low pressure gas-liquid separator is substantially improved and suitable for recycle purposes, and as a result only the net hydrogen need be subjected to the aforementioned purification process as required, for example, in the hydrotreating of sulfur-containing feedstocks.

It is an object of this invention to present a process for the catalytic reforming of hydrocarbons to produce gasoline boiling range products. It is another object to present a catalytic reforming process affording improved production of high purity hydrogen. It is still another object to present a catalytic reforming process affording improved separation of a hydrogen-rich vapor phase from the heavier components of the reaction mixture recovered from the reforming zone to maximize the recovery of both said vapor phase and said heavier components.

In one of its broad aspects, the present invention embodies a process for the catalytic reforming of a hydrocarbonaceous feedstock which comprises the steps of (a) contacting said feedstock with a reforming catalyst in a reforming zone in the presence of recycle hydrogen, said reforming zone being maintained at reforming conditions including a pressure of from about 50 to about 250 psig to produce an effluent stream comprising hydrogen admixed with hydrocarbon conversion products; (b) separating said effluent in a first gas-liquid liquid separation zone at a low pressure relative to said reforming zone and forming a hydrogen-rich vapor phase and a liquid hydrocarbon phase comprising the heavier hydrocarbon conversion products; (c) compressing one portion of said vapor phase to said reforming pressure and recycling the same to said reforming zone in admixture with the hydrocarbonaceous feedstock initially charged thereto to provide substantially all of said recycle hydrogen in accordance with step (a); (d) compressing the balance of said hydrogen-rich vapor phase to a high pressure relative to said reforming pressure; (e) admixing the vapor phase from step (d) with at least a portion of the liquid hydrocarbon phase from step (b) at said relatively high pressure; (f) treating the resulting mixture in a second gas-liquid separation zone at said relatively high pressure and forming a vapor phase comprising a relatively pure net hydrogen product and a liquid hydrocarbon phase comprising hydrocarbon conversion products; (g) discharging the net hydrogen product from the reforming process; and, (g) introducing the liquid hydrocarbon phase into a fractionation column at conditions to produce an overhead fraction comprising light hydrocarbon conversion products, and a higher boiling fraction comprising the heavier hydrocarbon conversion products.

Another embodiment of this invention includes the above process wherein said reforming conditions include a pressure of from about 75 to about 200 psig.

A still further embodiment includes the above process wherein said second gas-liquid separator is operated at a pressure of from about 250 to about 500 psig.

Other objects and embodiments of this invention will become apparent in the following detailed specification.

The present invention presents a further improvement in the art as set forth above. In particular, the process of the present invention provides for the recycle of hydrogen to the reforming zone without recourse to recontacting said stream with the liquid hydrocarbon phase from the low pressure gas-liquid separator as heretofore. practiced. Since the recycle hydrogen comprises the major portion of the vapor phase from said separator, it will be appreciated that the present process affords a substantial savings in utilities.

The art of catalytic reforming is well known to the petroleum refining industry and does not require detailed description herein. In brief, the catalytic reforming art is largely concerned with the treatment of a petroleum gasoline fraction to improve its anti-knock characteristics. The petroleum fraction may be a full boiling range gasoline fraction having an initial boiling point in the 50°–100° F. range and an end boiling point in the 325°–425° F. range. More frequently, the gasoline fraction will have an initial boiling point in the 150°–250° F. range and an end boiling point in the 350°–425° F. range, this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the selected gasoline fraction.

Widely accepted catalyst for use in the reforming process typically comprise platinum on an alumina support. These catalysts will generally contain from about 0.05 to about 5 wt.% platinum. More recently, certain promoters or modifiers, such as cobalt, nickel, rhenium, germanium and tin, have been incorporated into the reforming catalyst to enhance the reforming operation.

Catalytic reforming is a vapor phase operation. Operating conditions include the presence of the hereinabove mentioned catalysts and a pressure of from about 50 to about 250 psig., preferably from about 75 to about 200 psig. Satisfactory operating conditions further include a temperature of from about 500° to about 1050° F., preferably from about 600° to about 1000° F.; a liquid hourly space velocity of from about 0.2 to about 10; and sufficient hydrogen recyle to provide a hydrogen to hydrocarbon mole ratio in the reforming zone of from about 0.5 to about 15.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor, or the catalyst beds may each be enclosed in a separate reactor in a side-by-side reactor arrangement. Generally, a reaction zone will comprise 2–4 catalyst beds in either the stacked or side-by-side configuration. The amount of catalyst used in each of the catalyst beds may be varied to compensate for the endothermic heat of reaction in each case. For example, in a three catalyst bed system, the first bed will generally contain from about 10 to about 30 vol.%; the second, from about 25 to about 45 vol.%; and the third, from about 40 to about 60 vol.%. With respect to a four catalyst bed system, suitable catalyst loadings would be from about 5 to about 15 vol.% in the first bed, from about 15 to about 25 vol.% in the second, from about 25 to about 35 vol.% in the third, and from about 35 to about 50 vol.% in the fourth.

The reforming operation further includes the separation of a hydrogen-rich vapor phase from the reaction mixture recovered from the reforming zone, at least a portion of which is recycled to the reforming zone. This separation is usually effected at substantially the same pressure as employed in the reforming zone, allowing for pressure drop in the system as heretofore mentioned, and at a temperature of from about 60° to about 120° F. to yield a vapor phase comprising relatively pure hydrogen. A principally liquid phase is further treated in a fractionation column for the recovery of reformed product, commonly referred to as reformate.

The further description of the present invention is presented with reference to the attached schematic drawing. The drawing represents one preferred embodiment of the invention and is not intended as an undue limitation on the generally broad scope of the invention as set out in the appended claims. Miscellaneous hardware such as certain pumps, compressors, condensers, heat exchangers, coolers, valves, instrumentation and controls have been omitted or reduced in number as not essential to a clear understanding of the invention, the utilization of such hardware being well within the purview of one skilled in the art.

In brief description, there is shown a catalytic reforming zone 1, a first gas-liquid separator 5, a second gas-liquid separator 19, and a stabilizer column 24. The catalytic reforming zone 1 is preferably operated at reforming conditions including a pressure of from about 75 to about 200 psig. In view of the large pressure drop through a conventional reforming zone, typically comprising a plurality of stacked or side-by-side reactors, the reforming pressure referred to herein is intended as the pressure imposed at the inlet to the initial reactor of said reforming zone. The first gas-liquid separator 5 and the second gas-liquid separator 19 are operated at a temperature of from about 60° to about 120° F. The first gas-liquid separator 5 is preferably maintained at a pressure which is from about 25 to about 50 psig. lower than the reforming pressure, and the second gas-liquid separator 19 is preferably maintained at a pressure of from about 250 to about 500 psig. The stabilizer column 24 is suitably operated at a pressure of from about 250 to about 300 psig., a top temperature of from about 170° to about 300° F., and a bottoms temperature of from about 300° to about 500° F.

In a more specific example, a petroleum-derived naphtha fraction boiling in the 165°–410° F. range is charged to the catalytic reforming zone 1 of the attached drawing, the naphtha fraction being charged to the process via line 2 and introduced into the reforming zone through line 3 in admixture with a recycled hydrogen stream from line 10. A platinum-containing catalyst is contained in the reforming zone, and the reforming zone is maintained at reforming conditions including an inlet pressure of about 150 psig. The effluent from the reforming zone is recovered through line 4 at a pressure of about 125 psig. and passed through a cooling means, not shown, to enter the first gas-liquid separator 5 at a temperature of approximately 100° F. and at a pressure of about 110 psig. A hydrogen-rich vapor phase comprising about 84.6 mol.% hydrogen admixed with light ($C_1$–$C_6$) hydrocarbons is recovered from the gas-liquid separator 5 by way of line 6 at a rate of about 13,109 mols/hr, and a liquid hydrocarbon phase is recovered by way of line 7 at a rate of about 1,373 mols/hr. This liquid hydrocarbon phase is discharged through a pump 14 into line 15 to be recombined with the gaseous phase at a pressure of about 270 psig. as hereinafter related.

It has been observed that hydrogen production in the reforming zone increases with decreasing reforming pressure and improved catalyst formulations. As a result, at the relatively low reforming pressures and improved catalyst employed herein, the hydrocarbon concentration in the hydrogen-rich vapor phase from the gas-liquid separator 5 is reduced to the point where the added utilities cost associated with the processing of said hydrocarbons in admixture with the hydrogen recycled to the reforming zone are insufficient to warrant the utilities cost and capital expense associated with their separation in accordance with the prior art. Accordingly, a portion of the hydrogen-rich vapor phase passing through line 6, approximately 74 mol.%, is diverted into line 8 at a rate of about 9,691 mols/hr for recycle to the catalytic reforming zone 1. This recycle stream is processed through a compressor 9 and reenters the reforming zone 1 by way of line 10 and line 3 in admixture with the naphtha feedstock to provide a hydrogen/hydrocarbon mole ratio therein of about 6.

The net hydrogen-rich vapor phase recovered from the first gas-liquid separator 5 is continued through line 11 to a compressor 12 wherein it is increased in pressure to about 270 psig. The compressor effluent recovered in line 13 is then admixed with the liquid hydrocarbon phase recovered from the first gas-liquid separator 5 as heretofore stated, and the mixture is then continued through line 16 to a cooling means 17 wherein the temperature is reduced to about 100° F. The cooled mixture is transferred through line 18 to a second gas-liquid separator 19 wherein a gas-liquid separator is effected at said temperature of about 100° F. and at said pressure of about 260 psig. A purified hydrogen stream, comprising about 86.9 mol.% hydrogen, is recovered from the second gas-liquid separator 19 via an overhead line 20 at a pressure of about 260 psig., and at a rate of about 3,316 mols/hr. This represents more than a 99 mol.% net hydrogen yield recovery.

The liquid hydrocarbon phase that settles out in the second gas-liquid separator 19 is withdrawn via line 21 at a rate of about 1,475 mols/hr. The liquid hydrocarbon stream is transferred by means of a pump 22 and by way of line 23 to a stabilizer column 24, the liquid hydrocarbon stream being introduced into said column at a temperature of about 400° F. and at said pressure of about 260 psig. An overhead vapor stream is recovered from the stabilizer column via line 25 at a temperature of about 180° F. and passed through a cooling means 26 to an overhead receiver 27 via line 28. A gaseous phase comprising mainly residual hydrogen, methane, ethane and some higher boiling hydrocarbons is separated from the overhead receiver 27 through line 29 for use, for example, as a fuel gas. A liquid hydrocarbon condensate is recovered through line 30, and one portion thereof is recycled through line 31 to the top of the stabilizer column as reflux. The balance is withdrawn by way of line 32 at a rate of about 75 mols/hr. This latter stream comprises about 28.5 mol.% propane and 20.8 mol.% butanes. The reformate product is recovered from the stabilizer column via line 33 at about 1,352 mols/hr. Said column is operated at a bottoms temperature of about 520° F.

The following data illustrates the composition of certain relevant streams which comprise the process of the above example representing one preferred embodiment of this invention.

| Component, lb-mols/hr | Line No. 4 | 10 | 11 | 15 | 16 |
|---|---|---|---|---|---|
| $H_2$ | 11,089.1 | 8,194.0 | 2,890.8 | 4.3 | 2,895.1 |
| $C_1$ | 525.9 | 387.5 | 136.7 | 1.7 | 138.4 |
| $C_2$ | 489.8 | 356.9 | 125.9 | 7.0 | 132.9 |
| $C_3$ | 421.1 | 295.4 | 104.2 | 21.5 | 125.7 |
| $iC_4$ | 134.5 | 88.1 | 31.1 | 15.4 | 46.5 |
| $nC_4$ | 186.8 | 117.1 | 41.3 | 28.4 | 69.7 |
| $iC_5$ | 131.1 | 67.4 | 23.8 | 39.9 | 63.7 |
| $nC_5$ | 80.4 | 37.9 | 13.4 | 29.1 | 42.5 |
| $C_6$+ | 1,422.2 | 146.6 | 51.3 | 1,225.5 | 1,276.8 |
| Total | 14,480.9 | 9,690.7 | 3,418.5 | 1,372.8 | 4,791.3 |
| Lbs/hr | 259,102 | 78,165 | 27,520 | 153,577 | |
| Mol. Wt. | 17.9 | 8.1 | 8.1 | 111.9 | |
| B.p.s.d. | | | | 12,403.1 | |
| $10^6$ s.c.f.b. | 131.90 | 88.26 | 31.14 | | |

| Component, lb-mols/hr | Line No. 20 | 21 | 29 | 32 | 33 |
|---|---|---|---|---|---|
| $H_2$ | 2,883.1 | 12.0 | 11.6 | 0.4 | 0.0 |
| $C_1$ | 134.0 | 4.4 | 3.7 | 0.7 | 0.0 |
| $C_2$ | 117.1 | 15.8 | 9.6 | 6.2 | 0.0 |
| $C_3$ | 87.7 | 38.0 | 14.0 | 24.0 | 0.0 |
| $iC_4$ | 22.4 | 24.1 | 5.2 | 18.9 | 0.0 |
| $nC_4$ | 28.0 | 41.7 | 4.9 | 23.3 | 13.5 |
| $iC_5$ | 13.3 | 50.4 | 0.1 | 0.6 | 49.7 |
| $nC_5$ | 7.3 | 35.2 | 0.0 | 0.3 | 34.9 |
| $C_6$+ | 23.3 | 1,253.5 | 0.0 | 0.0 | 1,253.5 |
| Total | 3,316.2 | 1,475.1 | 49.1 | 74.4 | 1,351.6 |
| Lbs/hr | | 159,402 | 1,583 | 3,779 | 154,041 |
| Mol. Wt. | | 108.1 | 32.3 | 50.7 | 114.0 |
| B.p.s.d. | | 13,076.8 | | 477.4 | 12,368.5 |
| $10^6$ s.c.f.b. | | | 0.45 | | |

We claim as our invention:

1. A process for the catalytic reforming of a hydrocarbonaceous feedstock which comprises the steps of:

(a) contacting said feedstock with a reforming catalyst in a reforming zone in the presence of recycle hydrogen, said reforming zone being maintained at reforming conditions including a pressure of from about 50 to about 250 psig to produce an effluent stream comprising hydrogen admixed with hydrocarbon conversion products;

(b) separating said effluent in a first gas-liquid separation zone at a low pressure relative to said reforming zone and forming a hydrogen-rich vapor phase and a liquid hydrocarbon phase comprising the heavier hydrocarbon conversion products;

(c) compressing one portion of said vapor phase to said reforming pressure and recycling the same to said reforming zone in admixture with the hydrocarbonaceous feedstock initially charged thereto to provide substantially all of said recycle hydrogen in accordance with step (a);

(d) compressing the balance of said hydrogen-rich vapor phase to a high pressure relative to said reforming pressure;

(e) admixing the vapor phase from step (d) with at least a portion of the liquid hydrocarbon phase from step (b) at said relatively high pressure;

(f) treating the resulting mixture in a second gas-liquid separation zone at said relatively high pressure and forming a vapor phase comprising a relatively pure net hydrogen product and a liquid hydrocarbon phase comprising hydrocarbon conversion products;

(g) discharging the net hydrogen product from the reforming process; and, (h) introducing the liquid hydrocarbon phase into a fractionation column at conditions to produce an overhead fraction comprising light hydrocarbon conversion products, and a higher boiling fraction comprising the heavier hydrocarbon conversion products.

2. The process of claim 1 further characterized with respect to step (a) in that said reforming conditions include a pressure of from about 75 to about 200 psig.

3. The process of claim 1 further characterized with respect to step (b) in that said relatively low pressure is from about 25 to about 50 psig lower than the reforming pressure.

4. The process of claim 1 further characterized with respect to step (b) in that said first gas-liquid separation zone is maintained at a temperature of from about 60° to about 120° F.

5. The process of claim 1 further characterized with respect to step (d) in that said relatively high pressure is from about 75 to about 800 psig.

6. The process of claim 1 further characterized with respect to step (d) in that said relatively high pressure is from about 250 to about 500 psig.

7. The process of claim 1 further characterized with respect to step (f) in that said second gas-liquid separation zone is maintained at a temperature of from about 60° to about 120° F.

* * * * *